US009108086B1

(12) United States Patent
Weck

(10) Patent No.: US 9,108,086 B1
(45) Date of Patent: Aug. 18, 2015

(54) EXERCISE SYSTEM WITH WEIGHTED STACKABLE BASE ELEMENTS

(71) Applicant: David Weck, San Diego, CA (US)

(72) Inventor: David Weck, San Diego, CA (US)

( * ) Notice: Subject to any disclaimer, the term of this patent is extended or adjusted under 35 U.S.C. 154(b) by 193 days.

(21) Appl. No.: 13/913,387

(22) Filed: Jun. 8, 2013

(51) Int. Cl.
*A63B 26/00* (2006.01)
*A63B 47/00* (2006.01)
*A63B 21/06* (2006.01)

(52) U.S. Cl.
CPC ..... *A63B 47/00* (2013.01); *A63B 21/0602* (2013.01)

(58) Field of Classification Search
CPC ..... A63B 26/00–26/003; A63B 2225/62; A63B 21/00047
See application file for complete search history.

(56) References Cited

U.S. PATENT DOCUMENTS

| | | | | |
|---|---|---|---|---|
| 6,447,070 | B1 * | 9/2002 | Ekman et al. | 297/452.41 |
| 2009/0075792 | A1 * | 3/2009 | Stugart | 482/93 |
| 2013/0017937 | A1 | 1/2013 | Guarrasi | |

* cited by examiner

*Primary Examiner* — Loan H Thanh
*Assistant Examiner* — Rae Fischer
(74) *Attorney, Agent, or Firm* — LaMorte & Associates, P.C.

(57) ABSTRACT

An exercise system consisting of an inflatable assembly and stackable weight elements that can be used to support the inflatable assembly at different elevations. The inflatable assembly presents an inflated curved surface for body support. The stackable weight elements each have annular bodies that can be selectively filled with fill material. Each of the stackable weight elements have crenelated sections that intermesh when the stackable weight elements are vertically and concentrically stacked. The intermeshing of the stackable weight elements enables the stackable weight elements to remain highly stable when stacked and used to support the half-ball assembly.

12 Claims, 8 Drawing Sheets

EXERCISE SYSTEM WITH WEIGHTED STACKABLE BASE ELEMENTS

BACKGROUND OF THE INVENTION

1. Field of the Invention

In general, the present invention relates to exercise devices, such as inflated exercise balls and half-balls, that are used as body support surfaces while exercising. More particularly, the present invention relates to support structures used to selectively elevate such exercise balls and half-balls to various heights, and/or significantly stabilize exercise balls and half-balls when positioned with the inflatable dome side facing down. The present invention also relates to exercise weights that can be selectively filled with water.

2. Prior Art Description

Exercise trainers have discovered that there are many benefits that can be obtained by having a person support his/her body upon a large inflated ball while performing certain exercises. The inflated ball provides a soft rounded surface that prevents contact injuries. Furthermore, having a person balance his/her weight upon the curved surface causes that person to flex and exercise a larger variety of muscle groups. As such, certain exercises become more effective.

Large diameter exercise balls provide a wide surface upon which a person can easily rest his/her body. However, large diameter exercise balls can often be too high and too unstable to use for may types of exercises. Conversely, small diameter round exercise balls can support the body at a more comfortable height. However, small diameter balls do not provide a large enough area to safely and comfortably support a user's body and are also too unstable for many exercises. To eliminate the disadvantages of both large diameter exercise balls and small diameter exercise balls, half-ball assemblies have been developed in the exercise industry. Half-ball assemblies provide a large inflatable half-ball. The inflated half-ball provides the same support to a person as does a large diameter ball, since it has an inflatable dome the same diameter as the full ball. However, since only a half-ball is provided, the support provided is only half as high and mimics the height of a small diameter ball but the inflatable half-ball is more stable making it suitable for many more exercises. A prominent half-ball assembly being commercially sold is the BOSU® balance trainer created by Bosu Fitness LLC of San Diego, Calif.

Half-ball assemblies can also be used with the inflatable dome side facing down. In this orientation, the half-ball assembly is more unstable than it is with the dome side facing up. Although half-ball assemblies enable users to engage in many exercises, the utility of half-ball assemblies can be significantly increased for a wider group of people when they can be safely elevated and/or significantly stabilized when the dome side faces down.

In U.S. Patent Application Publication No. 2013/0017937 to Guarrasi, entitled Training Device For Balance Agility And Proprioception, a device is disclosed where a half-ball assembly can be positioned atop stacked risers in order to change the elevation of the half-ball assembly. However, the risers provided merely stack atop one another and do not mechanically engage either the adjacent risers or the half-ball assembly. The consequence is that the half-ball assembly can easily be shifted and dislodged off the risers during exercise. As a result, the riser and the base of the half-ball assembly must be made particularly wide in relation to the diameter of the half-ball assembly. The use of a wide base and a wide riser mandates that a person cannot step particularly close to the half-ball assembly while exercising. This limits the number of exercises that can be comfortably performed on the assembly.

A need therefore exists for a half-ball assembly that has the ability to be selectively elevated, yet remains highly stable when in an elevated condition when the dome side is facing up. A need also exists for a half-ball assembly that mechanically engages its supports to create a stable structure that can have a small width in relation to the elevated height of the half-ball structure. A need also exists for a half-ball assembly that can be significantly stabilized when the dome side faces down. These needs are met by the present invention as described and claimed below.

SUMMARY OF THE INVENTION

The present invention is an exercise system consisting of a half-ball assembly or a full ball assembly that are supported by stackable weight elements. The stackable weight elements can be used to support the half-ball/full ball assembly at different elevations.

The stackable weight elements each have annular bodies that can be selectively filled with water or another heavy fill material. The stackable weight elements are identical in structure, wherein each has a ledge sized to receive the periphery of the half-ball/full ball assembly and an open central area to receive the curvature of the supported ball assembly. Furthermore, each of the stackable weight elements has crenelated sections that intermesh when the stackable weight elements are vertically and concentrically stacked. The intermeshing of the stackable weight elements enables the stackable weight elements to remain highly stable when stacked and used to support the half-ball/full ball assembly.

The stackable weight elements also have handles that enable each of the stackable weight elements to be readily grasped and lifted. This assists in the stacking of the stable weight elements. It also enables the stackable weight elements to be used individually as weights in lifting exercises.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention exercise system can be embodied in many ways, the embodiment illustrated shows only one exemplary embodiment of the system. This embodiment is selected in order to set forth one of the best modes contemplated for the invention. The illustrated embodiment, however, is merely exemplary and should not be considered a limitation when interpreting the scope of the appended claims.

Figure 1:
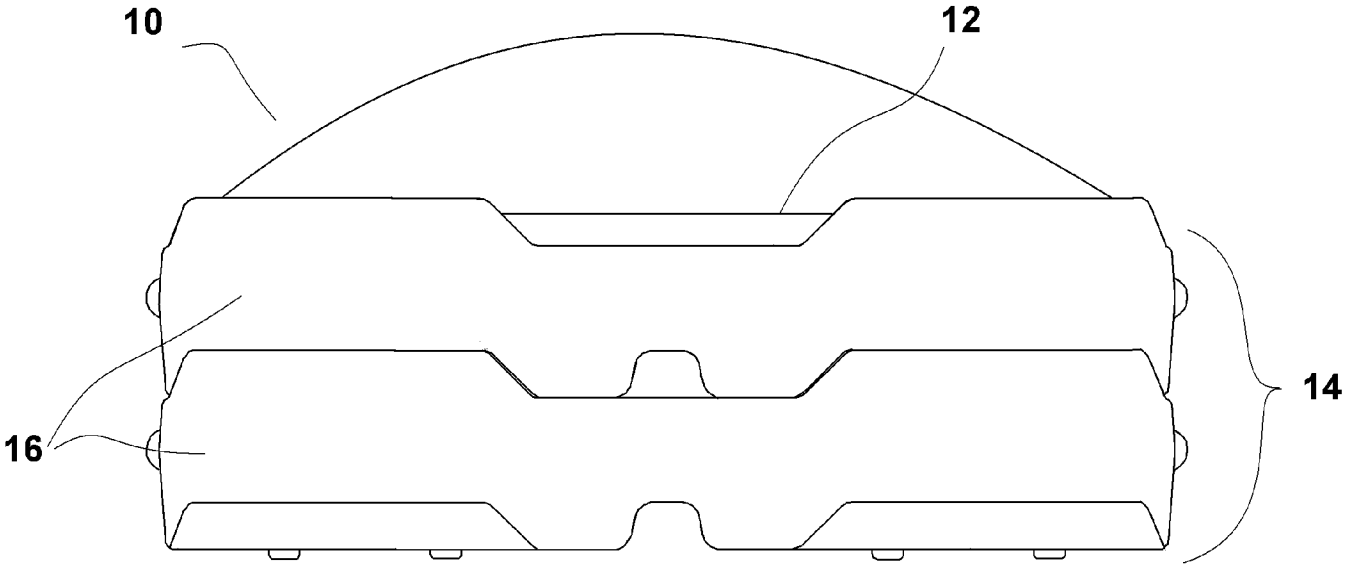
FIG. 1 is a front view of an exemplary embodiment of the present invention system.
Figure 2:
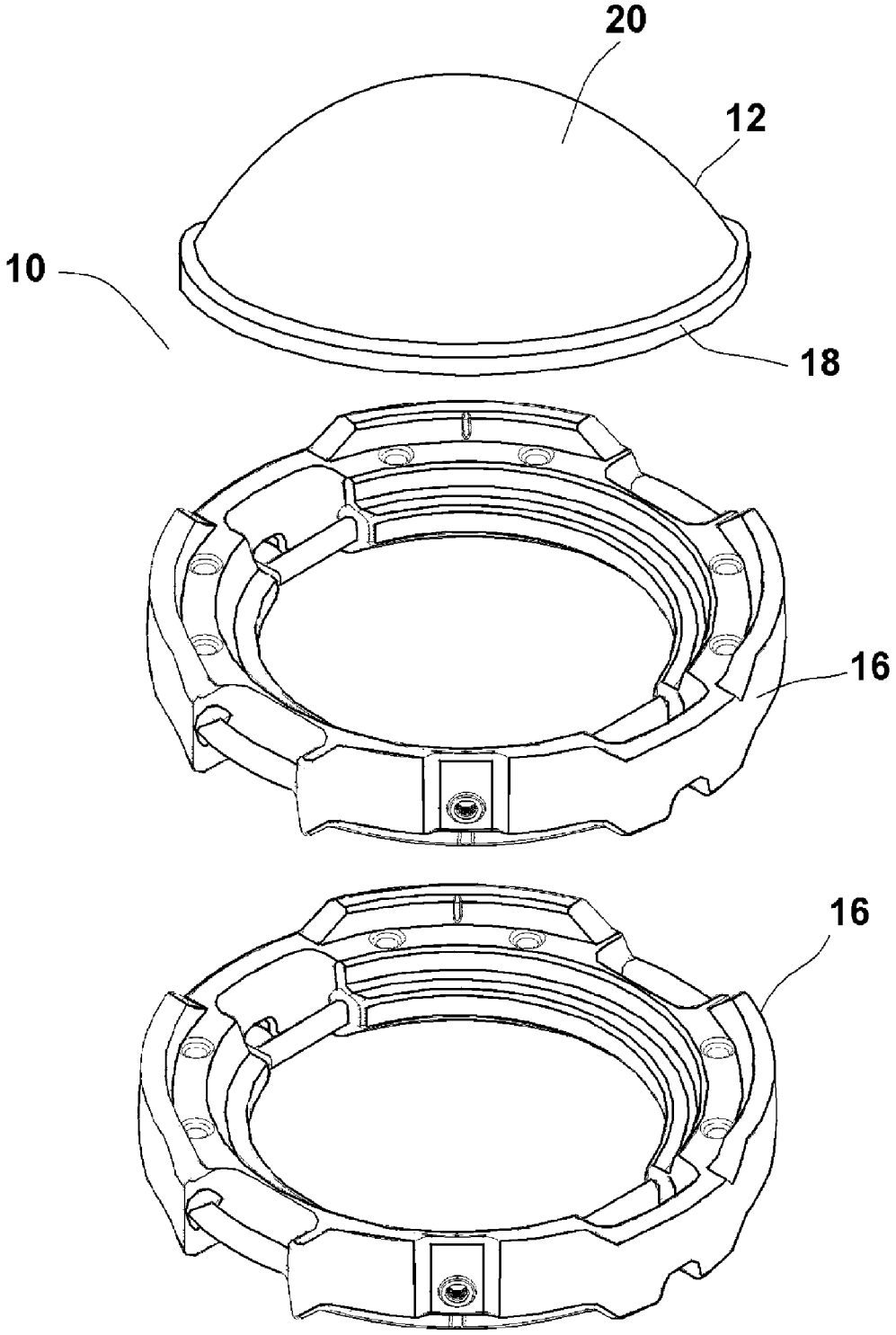
FIG. 2 is an exploded top perspective view of the exemplary embodiment of FIG. 1.

Referring to FIG. 1 in conjunction with FIG. 2, the present invention exercise system 10 is shown. The exercise system 10 consists of an inflatable assembly 11 that rests upon a stack 14 of support elements 16. The inflatable assembly 11 can be a round inflated exercise ball. However, in the shown exemplary embodiment, the inflatable assembly 11 is a half-ball assembly 12. As will be later explained, the physical structure of each of the support elements 16 is identical and is configured to intermesh with another when vertically and concentrically stacked. As such, it will be understood that although only two support elements 16 are shown, any plurality of support elements 16 can be vertically stacked. The more support elements 16 that are used, the higher the elevation at which the half-ball assembly 12 can be supported.

The purposes of the support elements 16 are twofold. First, the support elements 16 are concentrically stacked to support the inflatable assembly 11 at a desired elevation. This elevation is selectively altered by adding or removing support elements 16 in the vertical stack 14. Second, the support elements 16 provide a weighted, stable base for the inflatable assembly 11 that inhibits movement of the inflatable assembly 11 as it is in contact with an exercising person.

Figure 4:
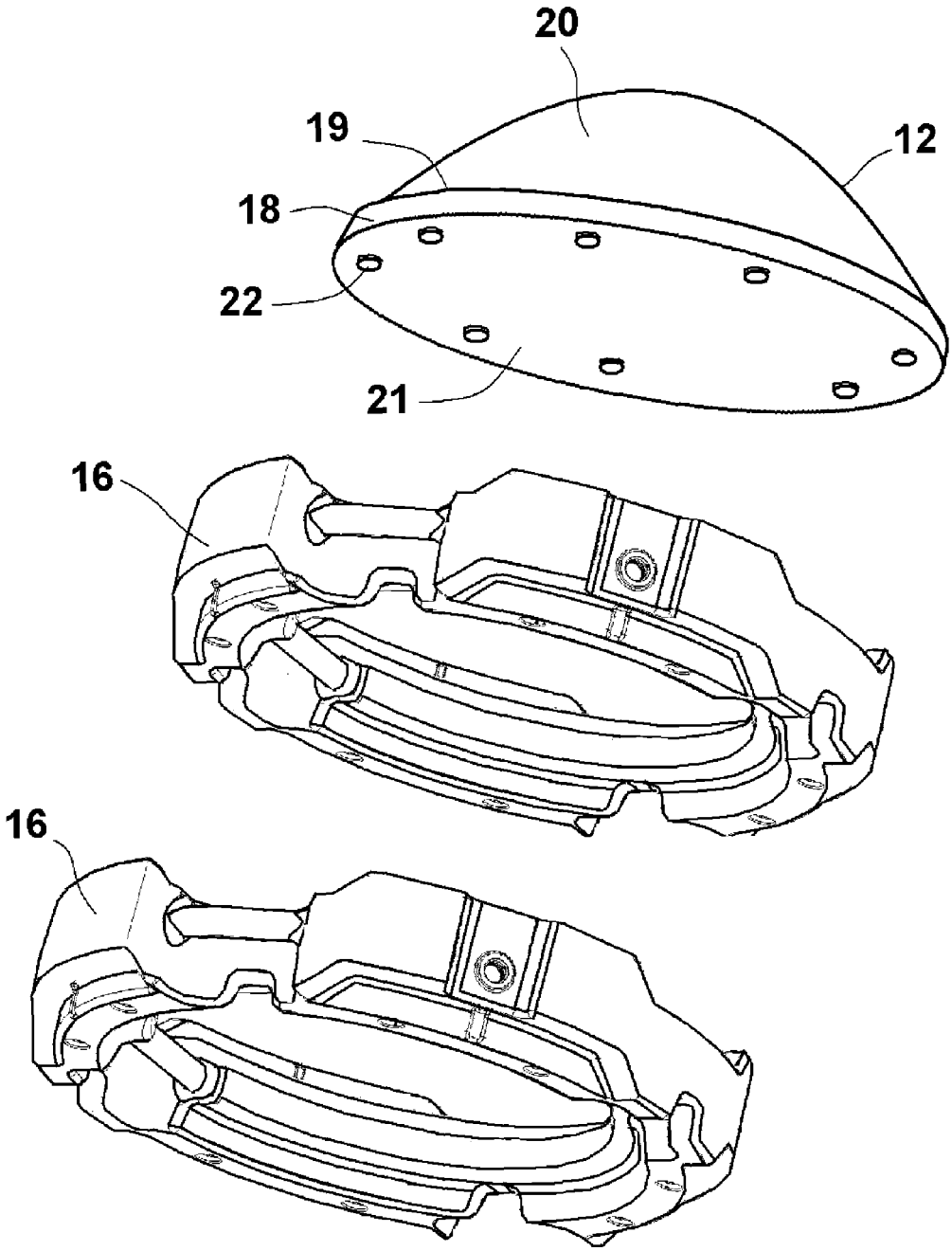
FIG. 4 is an exploded bottom perspective view of the exemplary embodiment of FIG. 1.

Referring to FIG. 4 in conjunction with FIG. 2, it can be seen that the inflatable assembly 11 illustrated is shown as a half-ball assembly 12. The half-ball assembly 12 has a base plate 18. The base plate 18 is circular, having both a circular top surface 19 and a circular bottom surface 21. An inflatable hemispherical element 20 is affixed to the top surface 19 of the base plate 18. The maximum diameter of the inflatable hemispherical element 20 is slightly less than the diameter of the circular base plate 18. As a result, the periphery of the base plate 18 is exposed at all points around the bottom of the inflatable half ball 12.

Padded foot protrusions 22 are disposed on the bottom surface 21 of the base plate 18. The padded foot protrusions 22 are set into a predetermined pattern, the significance of which is later explained. The padded foot protrusions 22 support the half-ball assembly 12 should the half-ball assembly 12 be set directly onto the ground.

Figure 3:
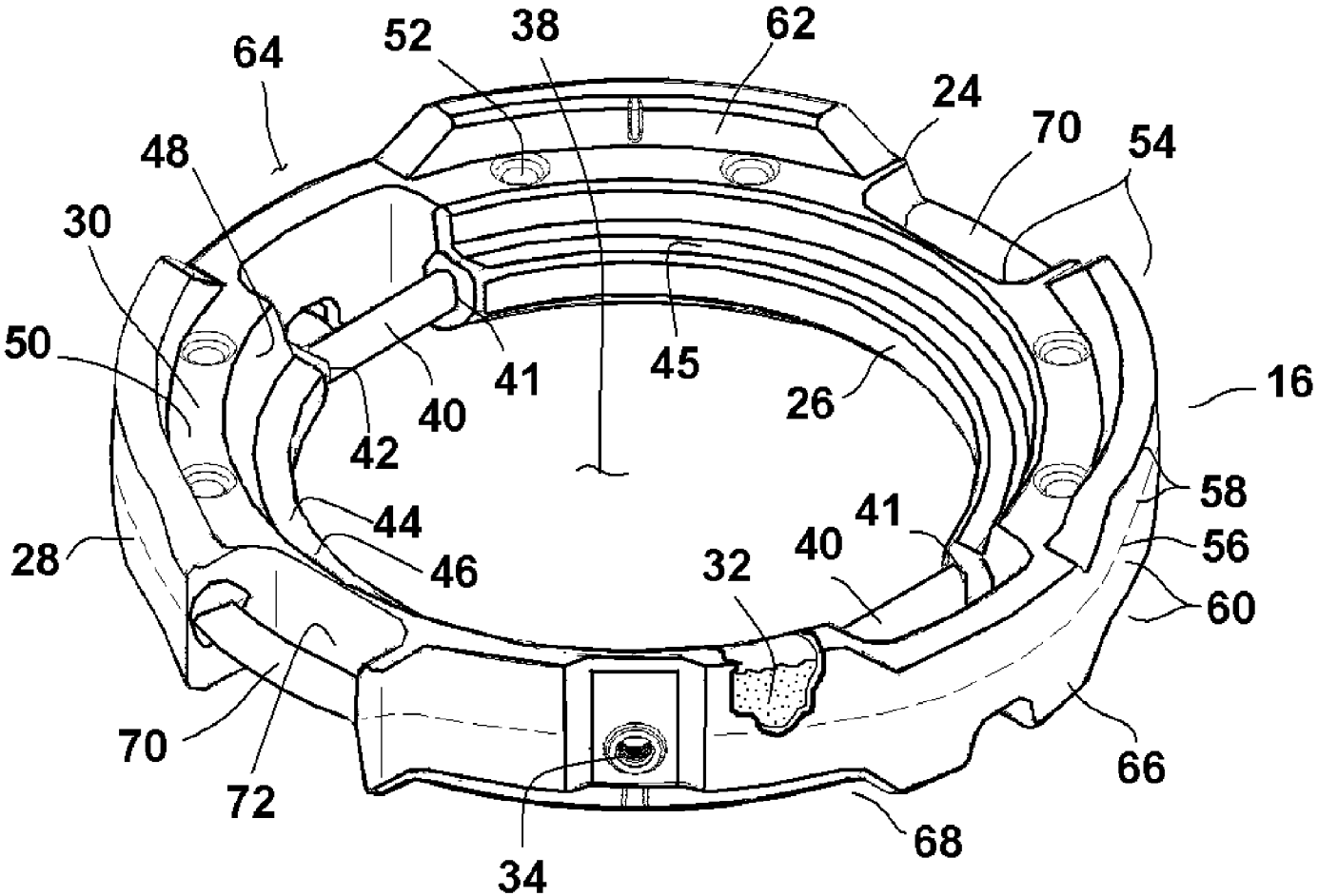
FIG. 3 is a top perspective view of a support element used in the exemplary embodiment.

Referring to FIG. 3 in conjunction with FIG. 2 and FIG. 4, it can be seen that each support element 16 has an annular body 24 with a stepped construction. That is, the annular body 24 has an inside edge 26 and a peripheral edge 28. A top surface 30 of the annular body 24 steps down from the peripheral edge 28 to the inside edge 26.

The annular body 24 is hollow, therein defining an internal chamber 32. The internal chamber 32 is watertight and is accessible through a fill/drain port 34. The fill/drain port 34 is threaded to receive and retain a removable plug or cap. It will therefore be understood that the internal chamber 32 can be selectively filled with a volume of water, loose sand or other fill material that provides the support element 16 with significant additional weight.

As viewed from the top, the inside edge 26 of the annular body 24 defines an open central area 38. Two handles 40 are formed along the inside edge 26 at opposite sides of the annular body 24. Each of the two handles 40 has a first end 41 and a second end 42. The open central area 38 is encircled by a first level ledge 44. The first level ledge 44 has two sections 45, 46 that are coplanar. The first section 45 of the first level ledge 44 extends between the first ends 41 of the inside handles 40. Conversely, the second section 46 of the first level ledge 44 extends between the second ends 42 of the inside handles 40. The first level ledge 44 in both the first section 45 and the second section 46 extends horizontally from the inside edge 26 to a vertical wall 48. The vertical wall 48 progresses along a path that is concentric with the open central area 38.

The vertical wall 48 extends upwardly to a second level ledge 50. The second level ledge 50 presents a horizontal surface that is concentric with the open central area 38. A plurality of small depressions 52 are formed along the second level ledge 50. The small depressions 52 are set in a pattern that matches the pattern of the padded foot protrusions 22 that extend from the bottom surface 21 of the half-ball assembly 12. The diameter of the second level ledge 50 matches the diameter of the base plate 18 on the half-ball assembly 12. As such, it will be understood that the base plate 18 of the half-ball assembly 12 can be set atop the second level ledge 50, wherein the padded foot protrusions 22 on the half-ball assembly 12 engage the small depressions 52. This engagement prevents the half-ball assembly 12 from rotating independently of the support elements 16 when the half-ball assembly 12 rests upon the support elements 16.

The second level ledge 50 is surrounded by a crenelated section 54. The crenelated section 54 extends from the second level ledge 50 to the outer peripheral edge 28. In FIG. 3, a support element 16 is shown with an imaginary equatorial line 56 that encircles the annular body 24 in the horizontal plane. The equatorial line 56 is imaginary and is used only for reference to divide the annular body 24 in the horizontal plane between an upper half 58 and a lower half 60.

In the upper half 58 of the annular body 24, the crenelated section 54 has merlons 62 that terminate a first distance away from the equatorial line 56, and embrasures 64 that terminate a closer second distance from the equatorial line 56. The upper merlons 62 and the upper embrasures 64 are interposed in a symmetrical pattern around the periphery of the annular body 24. This provides the upper half 58 of the crenelated section 54 with a toothed configuration of high sections and low sections.

Conversely, in the lower half 60 of the annular body 24, the crenelated section 54 has lower merlons 66 and lower embrasures 68 that are the negatives of upper merlons 62 and upper embrasures 64. That is, under each upper merlon 62 is formed a lower embrasure 68 of generally the same dimensions. Likewise, under each upper embrasure 64 is a lower merlon 66 of generally the same dimensions.

Two outside handles 70 are provided on the peripheral edge 28 along the equatorial line 56. The outside handles 70 are offset from the inside handles 40 by 90 degrees in the horizontal plane. As such, it will be understood that each support element 16 has four handles 40, 70, that include two inside handles 40 and two outside handles 70. Reliefs 72 are formed into the support elements 16 behind each of the four handles 40, 70. The reliefs 72 provide room for a hand to grasp the handles 40, 70.

Figure 5:
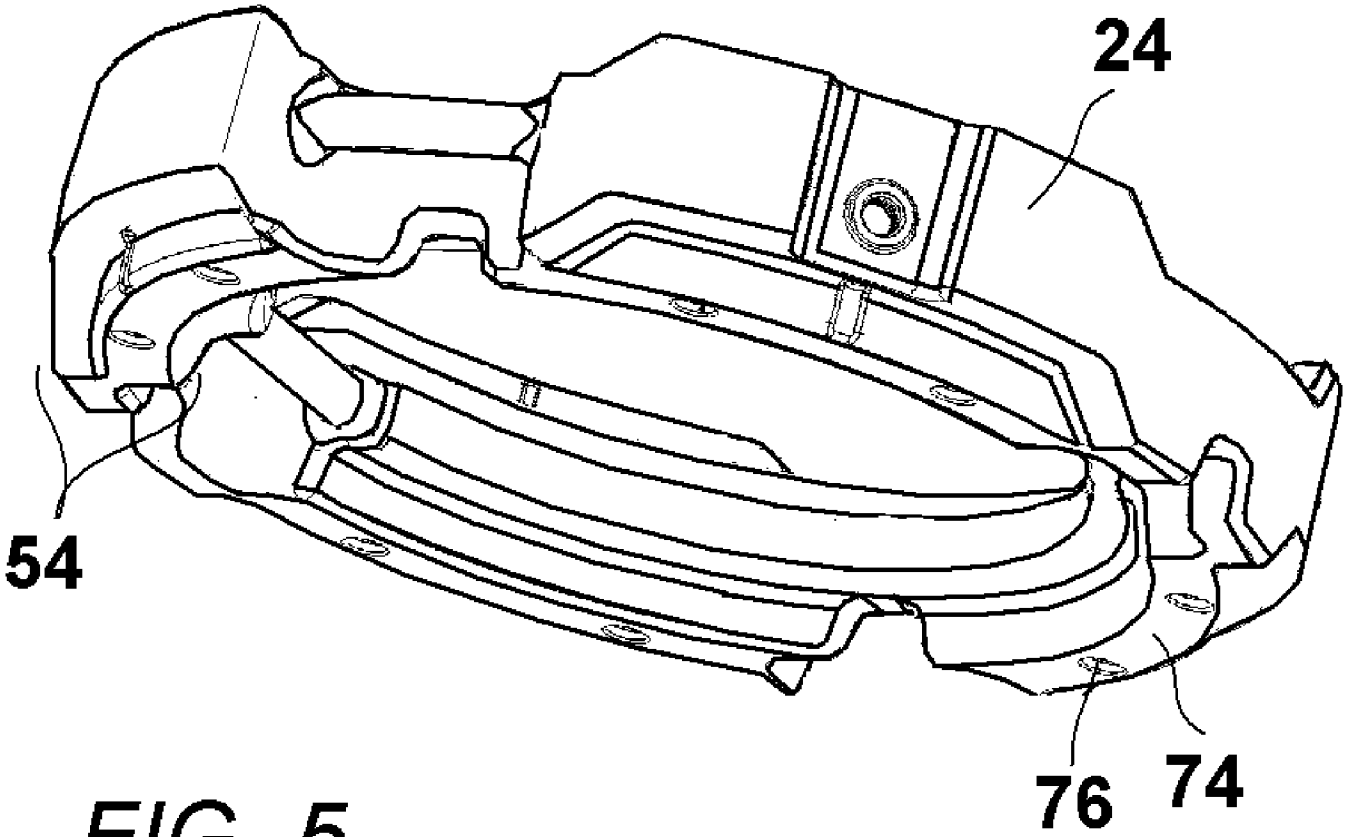
FIG. 5 is a bottom perspective view of the support element shown in FIG. 4.

Referring to FIG. 4 in conjunction with FIG. 5 and FIG. 3, it can be seen that when viewed from below, the stepped construction of the annular body 24 produces a protruding ring 74 on its bottom surface. The protruding ring 74 is just inside the crenelated section 54. The protruding ring 74 has the same diameter as the second level ledge 50 on the opposite side of the annular body 24. This enables the bottom of one support element 16 to be received into the top of an underlying support element 16 when the support elements 16 are vertically stacked.

Small foot protrusions 76 are disposed on the protruding ring 74. The foot protrusions 76 are set into the same pattern as the small depressions 52 on the second level ledge 50. The foot protrusions 76 engage the depressions 52 when the support elements 16 are vertically stacked.

Referring now to FIG. 1 through FIG. 5, it will be understood that when the support elements 16 are concentrically stacked, the protruding ring 74 on one support element 16 rests upon the second level ledge 50 of a below lying second support element 16. Likewise, the crenelated sections 54 of the two support elements 16 intermesh, with the lower merlons 66 and embrasures 68 of the higher support element 16 being received in the lower embrasures 64 and merlons 62 of a lower support element, respectively. The intermeshing of the crenelated sections 54 mechanically locks the support elements 16 together and prevents any one support element 16 from sliding or turning independently of the others.

Figure 6:
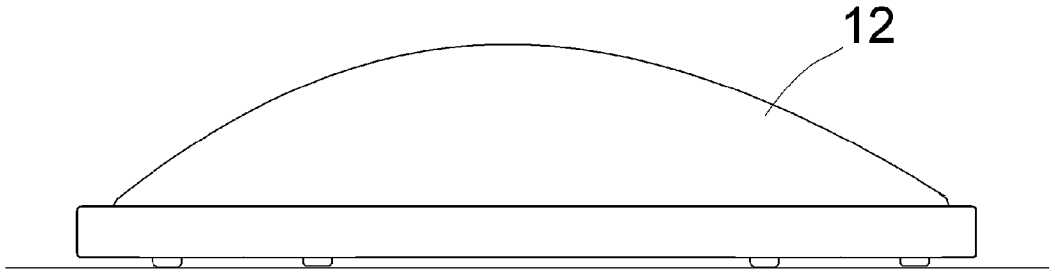
FIG. 6 shows an unelevated configuration of the present invention system.
Figure 7:
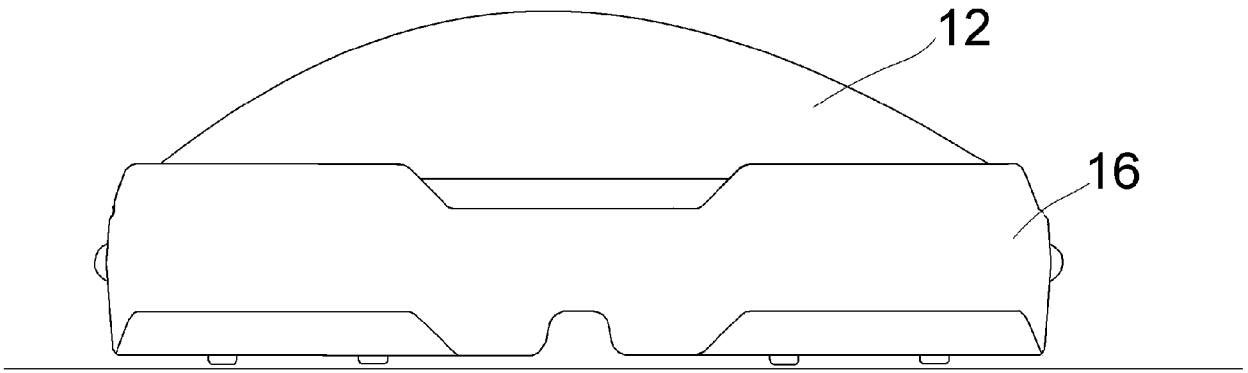
FIG. 7 shows a partially elevated configuration of the present invention system.
Figure 8:
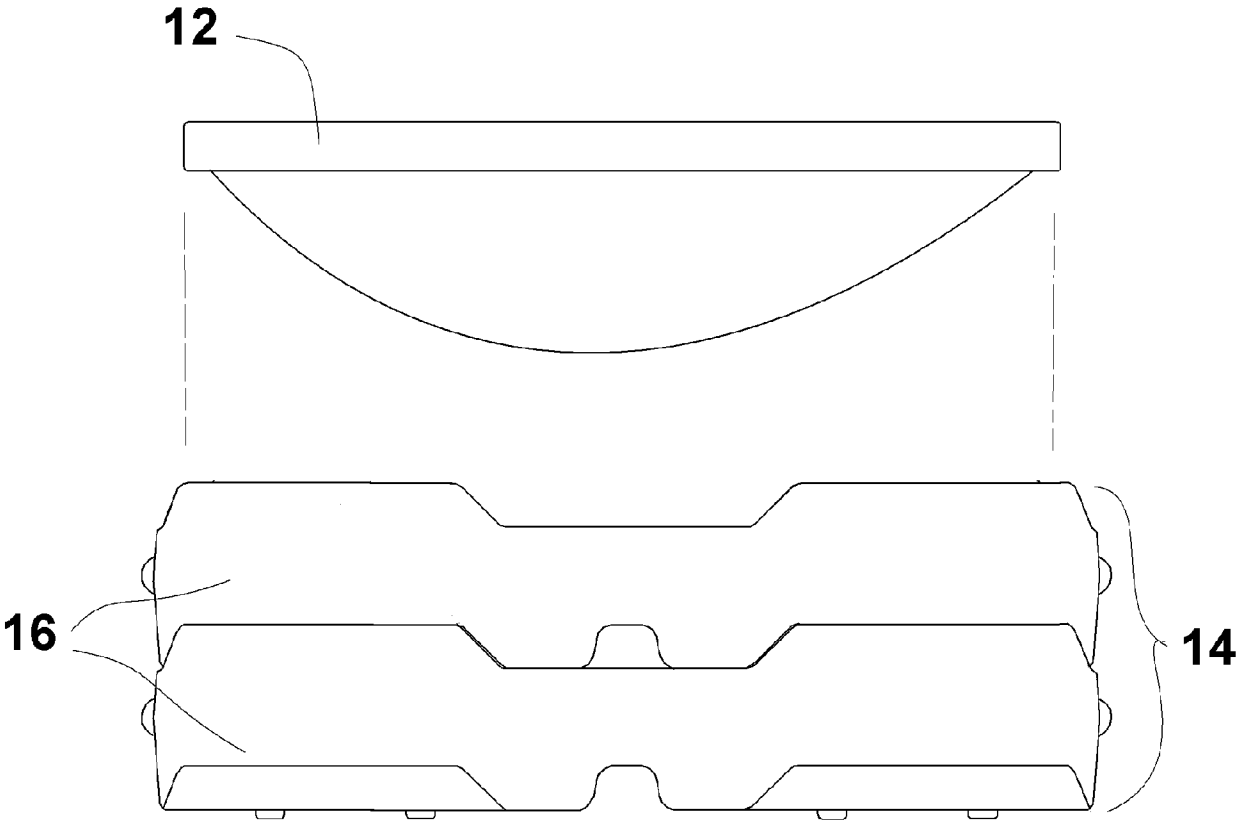
FIG. 8 shows an alternate configuration of the present invention system.

From the above, it will be understood that the exercise system 10 can be configured in multiple ways. As is indicated in FIG. 6, the half-ball assembly 12 can be placed upon a flat surface directly and used for exercises. As is indicated by FIG. 7, the half-ball assembly 12 can be set into one support element 16. As is indicated by FIG. 1, the half-ball assembly 12 can be set upon a stack 14 containing a plurality of support elements 16. Referring to FIG. 8, it can also be seen that the half-ball assembly can be inverted on the stack 14 of support elements 16 configuration to create a solid elevated support. This orientation is made possible by the annular shape of the support elements 16, wherein the hemispherical element extends into the open central area 38 inside the support elements 16 when the half-ball assembly 12 is inverted. FIG. 8 also illustrates how the support elements 16 could retain a full ball assembly instead of the previously described half-ball assembly 12. If a fill ball assembly were supported, half of the ball could pass into the open central area 38 inside the support elements 16. The remainder of the full ball assembly would extend above the support elements 16, giving the overall assembly the same general appearance as the half-ball assembly 12 illustrated in the exemplary embodiments.

Figure 9:
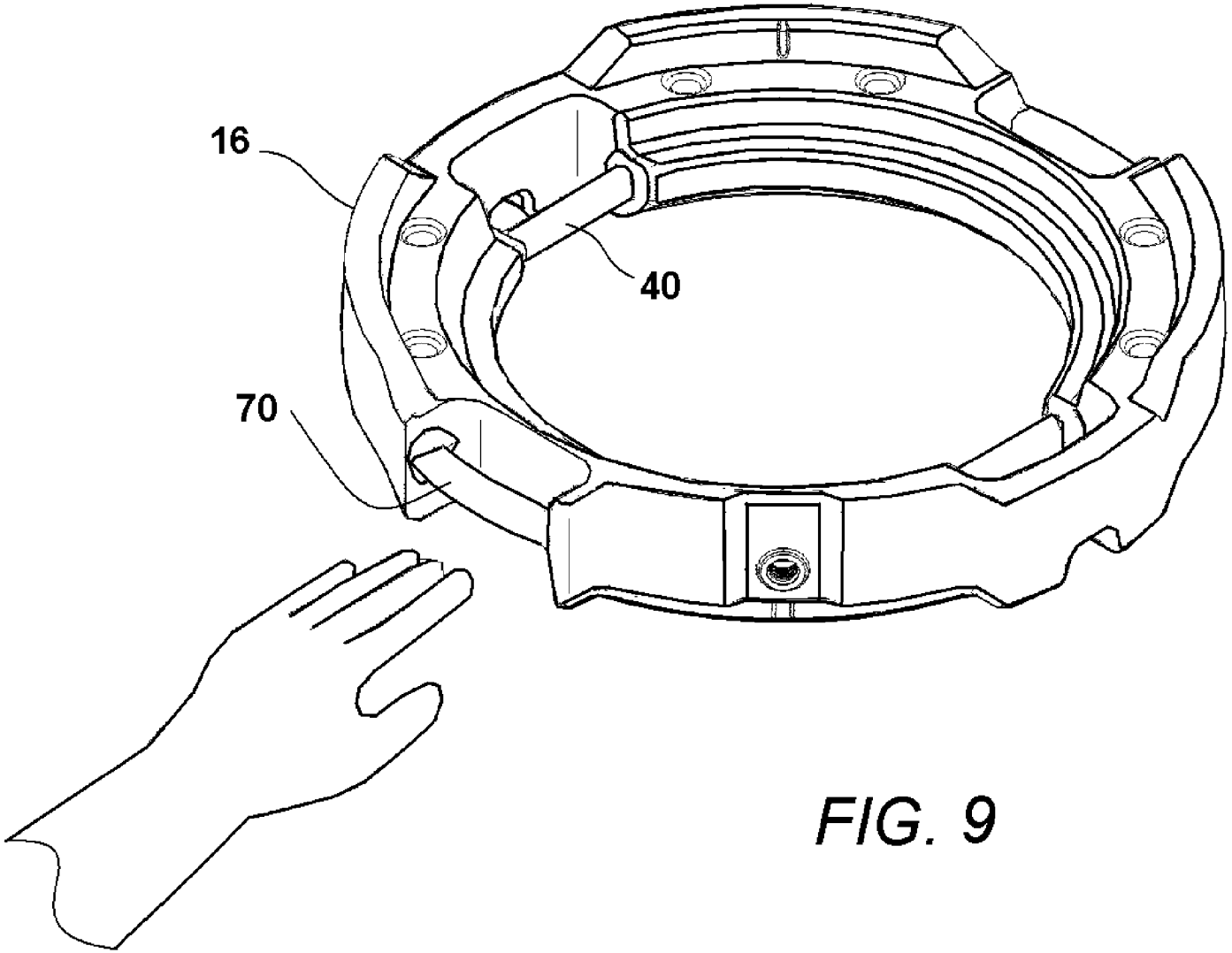
FIG. 9 shows a lone support element being used as a weight.

Lastly, referring to FIG. 9, it can be seen that each of the support elements 16 can be used independently to perform exercises. Each of the support elements 16 can be grasped by some of its handles 40, 70 and used as a weight. The mass of the support element 16 can be selectively controlled by varying the volume of fill material contained within the support element 16.

It will be understood that the embodiment of the present invention system that is illustrated and described is merely exemplary and that a person skilled in the art can make many variations to that embodiment. For example, the support elements can be made into various geometric shapes. Likewise, the height of the support elements can be varied as can the shape of the crenelated sections. All such embodiments are intended to be included within the scope of the present invention as defined by the claims.

What is claimed is:

1. An exercise system, comprising:

an inflatable assembly that creates a curved support surface when inflated;

a plurality of annular support elements structured and arranged to receive said inflatable assembly, each of said annular support elements having an inside edge that encircles an open central area, wherein each of said annular support elements defines a ledge that is sized to receive said inflatable assembly thereon, wherein each of said annular support elements has a peripheral edge with protrusions and reliefs spaced there along, and wherein said protrusions and reliefs from adjacent annular support elements intermesh when said annular support elements are concentrically stacked, and wherein each of said annular support elements has a body that extends from said inside edge to said peripheral edge, wherein said body defines at least one watertight internal compartment and a closable port for filling the at least one watertight internal compartment with a fill material.

2. The system according to claim 1, wherein said inflatable assembly is selected from a group consisting of inflatable half balls and inflatable full balls.

3. The system according to claim 1, wherein each of said plurality of annular support elements further includes a closable port for filling said at least one watertight internal compartment with a fill material.

4. The system according to claim 1, further including a first handle coupled to said body.

5. The system according to claim 4, wherein said first handle is disposed along said inside edge.

6. The system according to claim 5, further including a second handle disposed along said peripheral edge.

7. The system according to claim 6, wherein reliefs are formed in said annular body adjacent said first handle and said second handle to provide room to grasp said first handle and said second handle.

8. The system according to claim 1, wherein said base has foot protrusions, wherein said ledge on each of said annular support elements has depressions thereon that can receive said foot protrusions.

9. The system according to claim 1, wherein said inflatable assembly includes a half-ball assembly having a base plate upon which an inflatable hemispherical element is mounted.

10. The system according to claim 9, wherein said ledge is shaped to receive and retain said base plate of said half-ball assembly.

11. The system according to claim 1, further including two inside handles that are disposed along said inside edge in opposing positions.

12. The system according to claim 11, further including two outside handles that are disposed along said peripheral edge in opposing positions.

* * * * *